US005189471A

United States Patent [19]

Irihara et al.

[11] Patent Number: 5,189,471

[45] Date of Patent: Feb. 23, 1993

[54] IMAGE FORMING APPARATUS WITH SLIDABLY MOUNTED DEVELOPING UNIT AND PHOTOCONDUCTIVE UNIT

[75] Inventors: Kouichi Irihara; Yukinori Andou; Yuhi Yui, all of Nara, Japan

[73] Assignee: Sharp Kabushiki Kaisha, Osaka, Japan

[21] Appl. No.: 534,148

[22] Filed: Jun. 6, 1990

[30] Foreign Application Priority Data

Jun. 7, 1989 [JP] Japan ..... 1-67072[U]

[51] Int. Cl.[5] ..... G03G 21/00; G03G 15/00

[52] U.S. Cl. ..... 355/210

[58] Field of Search ..... 355/200, 210, 211, 212, 355/213

[56] References Cited

U.S. PATENT DOCUMENTS

| | | | |
|---|---|---|---|
| 3,998,537 | 12/1976 | Smith et al. | 355/260 |
| 4,096,826 | 6/1978 | Stange | 355/212 X |
| 4,279,496 | 7/1981 | Silverberg | 355/212 |
| 4,325,626 | 4/1982 | Murata et al. | 355/211 |
| 4,327,992 | 5/1982 | Babicz | 355/210 |
| 4,634,264 | 1/1987 | Takahashi | 355/200 |
| 4,873,548 | 10/1989 | Kobayashi et al. | 355/200 |
| 4,951,093 | 8/1990 | Ishii et al. | 355/211 X |

*Primary Examiner*—Fred L. Braun

*Attorney, Agent, or Firm*—Morrison & Foerster

[57] ABSTRACT

An image forming apparatus shown has a developing unit and a photoconductor unit both of which are disposed in a body. The developing unit and photoconductor unit are slidably mounted adjacent to each other within the body. The mounting and positioning of the units are such as to allow the developing unit and the photoconductor unit to be successively pulled out of the body. The apparatus further includes an urging member which allows the photoconductor unit to be urged toward the developing unit. The body includes upper and lower housings and is designed so that the upper housing can be swung upward about a fulcrum on one side of the body and thereby form an opening between the upper and lower housings on the other side of the body. The apparatus is designed and the components are configured such that when the developing unit is pulled out of the body the photoconductor unit moves toward the opening and the photoconductor unit can be replaced in a large open space near the opening.

3 Claims, 3 Drawing Sheets

IMAGE FORMING APPARATUS WITH SLIDABLY MOUNTED DEVELOPING UNIT AND PHOTOCONDUCTIVE UNIT

BACKGROUND OF THE INVENTION

1. Field of the invention

The present invention relates to an image forming apparatus which comprises detachable process-units such as a photoconductor unit, a developing unit, and the like, each of which integrally contains components and consumable supplies associated with each other for performing each step of the image-forming process, so that the replacement of such components and consumable supplies can be performed simply by replacing the corresponding process-unit.

2. Description of the prior art

With the recent increase of personal use, image forming apparatuses such as electrostatic process copying machines have been developed which comprise process-units such as a photoconductor unit, a developing unit, etc., so that the components and consumable supplies contained therein can be replaced with ease at the user side, simply by replacing the process-unit.

FIG. 3 shows a typical image-forming apparatus of this type, wherein a photoconductive drum 11, a charger 12, and a cleaner 13 constitute a photoconductor unit 14, while a toner hopper 15 and a developer tank 16 make up a developing unit 17. The photoconductor unit 14 and the developing unit 17 are both supported on a rail 18. A door 19 provided on one side of the apparatus (i.e., on the right side in FIG. 3) can be opened to rest in a position indicated by the two-dot dash lines. The door 19 is opened when the developing unit 17 and the photoconductor unit 14 are to be removed for replacement.

Generally, image forming apparatuses for which components and consumable supplies can be replaced as process-units by the user are designed in compact size, making full and effective use of the machine's internal space and leaving hardly any idle space therein. This has in turn restricted the space for the replacement of the developing unit 17, the photoconductor unit 14, etc., thereby making it difficult for the user to replace them and giving rise to a possibility of damaging adjacent components during the replacement work. Such problems have been particularly easy to arise when replacing the photoconductor unit 14 which is installed in the middle part of the copying machine because it requires work deep inside the machine.

SUMMARY OF THE INVENTION

The image forming apparatus of this invention, which overcomes the above-discussed and numerous other disadvantages and deficiencies of the prior art, comprises: a developing unit disposed in a body; a photoconductor unit disposed in said body; a rail on which said developing unit and said photoconductor unit are slidably mounted adjacent to each other, allowing the developing unit and the photoconductor unit to be successively pulled out of said body; and an urging member for urging said photoconductor unit toward said developing unit.

In a preferred embodiment, the developing unit is urged at one end thereof by the photoconductor unit toward a positioning member which is provided at the other end and slidably engaged with the rail, said positioning member being locked at a predetermined position of said rail so as to keep said developing unit in a fixed position.

In a preferred embodiment, the body of the apparatus comprises an upper housing and a lower housing, said upper housing being pivotably connected to said lower housing at a fulcrum located on one side of said body, thereby allowing said upper housing to be swung upward about said fulcrum away from said lower housing.

In a preferred embodiment, the developing unit and the photoconductor unit are successively pulled out of the body in that order in a direction away from the fulcrum.

Thus, the invention described herein makes possible the objectives of (1) providing an image forming apparatus in which the replacement of the photoconductor unit can readily be carried out in a large space; (2) providing an image forming apparatus in which the replacement of the photoconductor unit can be carried out without damaging the other components adjacent thereto; and (3) providing an image forming apparatus in which the developing unit and the photoconductor unit are accurately positioned with respect to the other components in the body of the apparatus.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
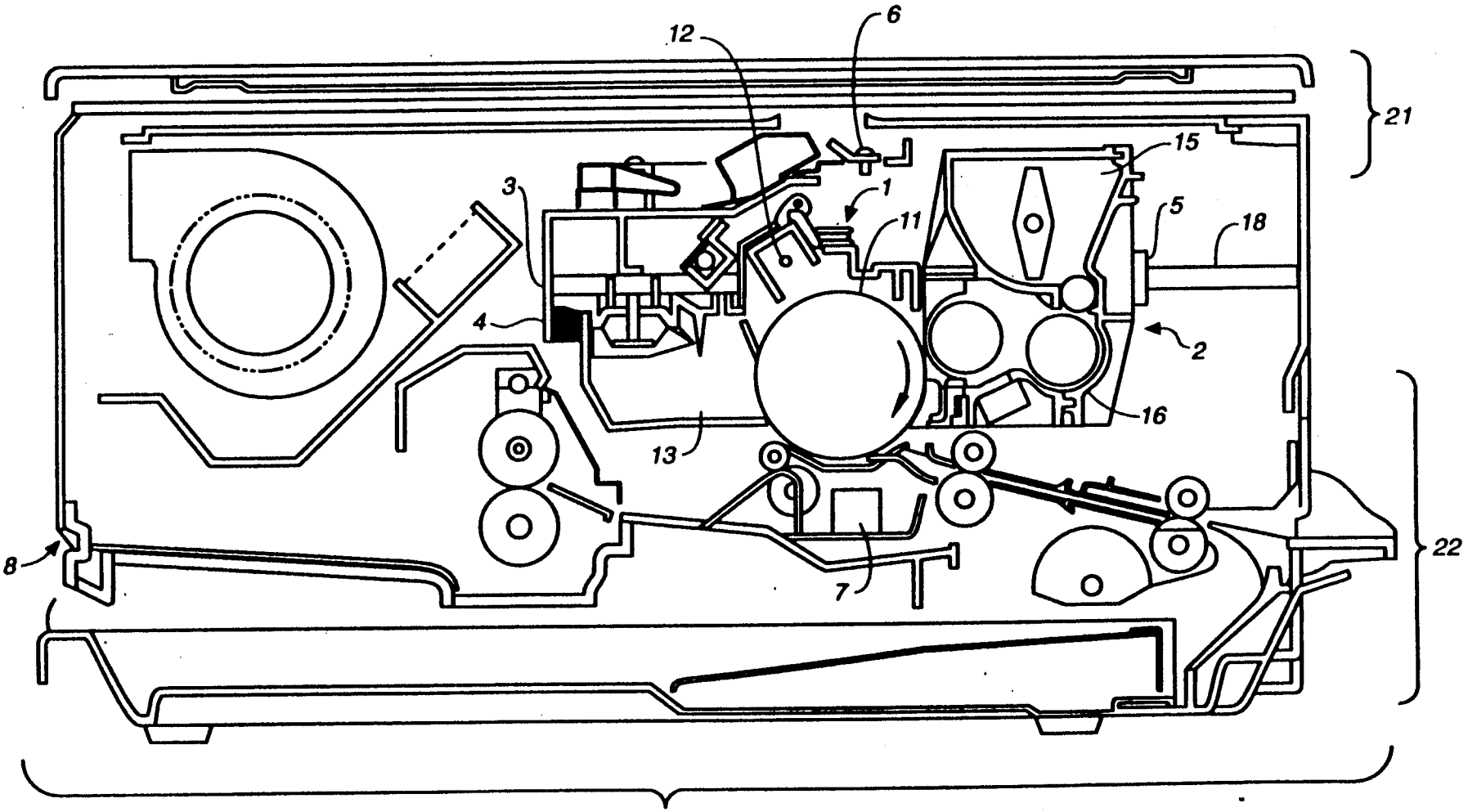
FIG. 1 is a sectional side elevation of an image forming apparatus of the invention.
Figure 2:
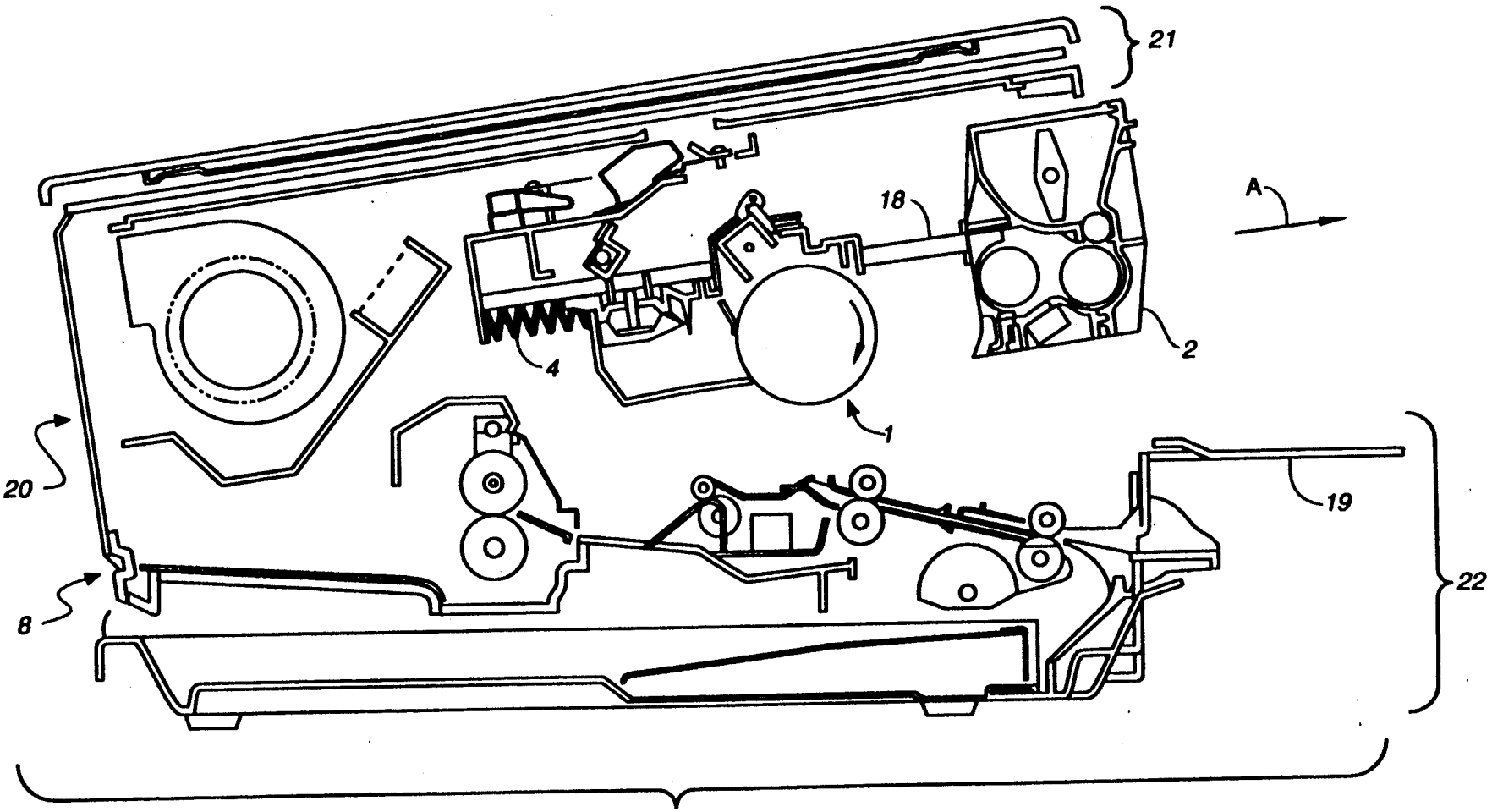
FIG. 2 is a sectional side elevation of the image forming apparatus of FIG. 1 at the time when a developing unit and a photoconductor unit are being removed for replacement.
Figure 3:
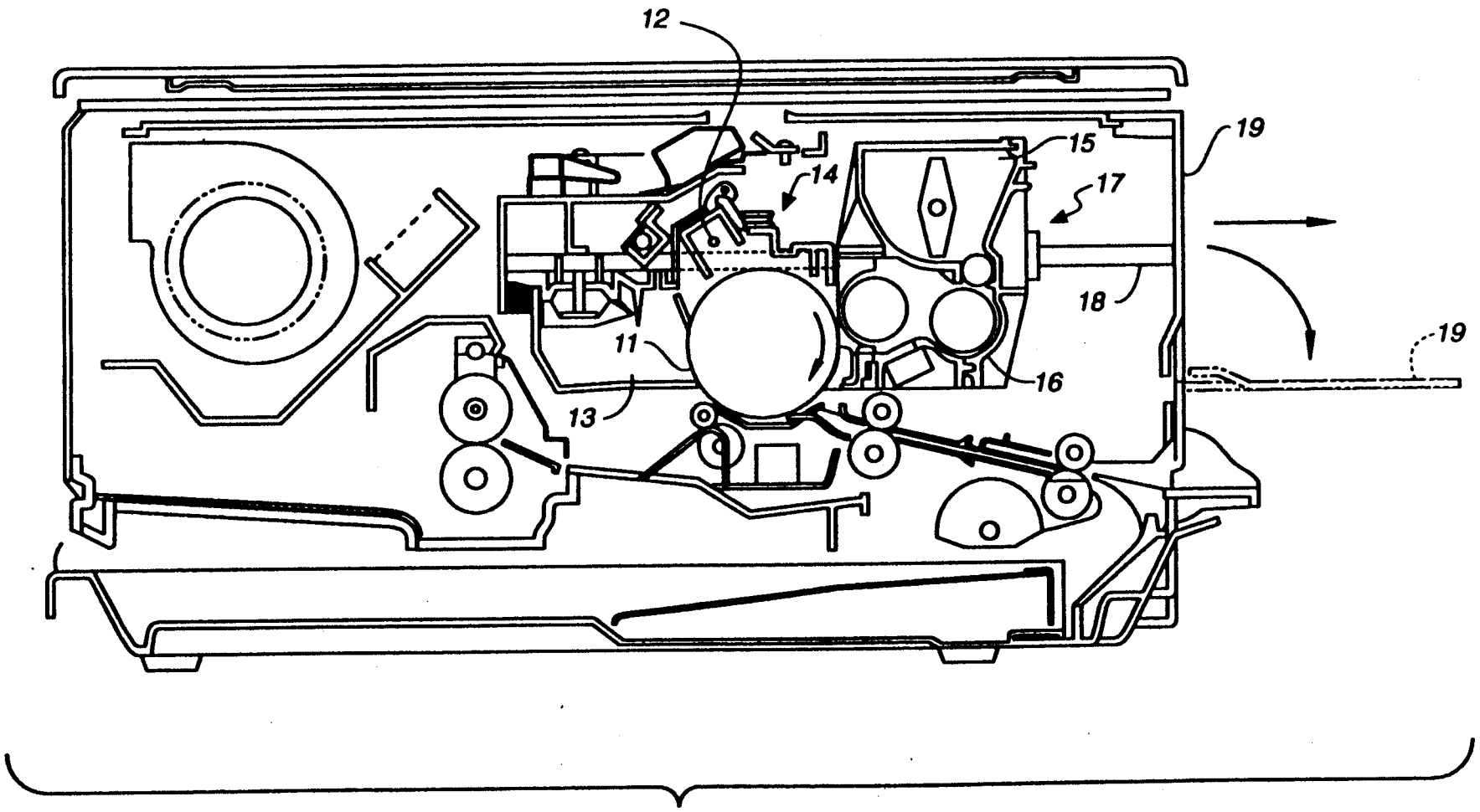
FIG. 3 is a sectional side elevation of a conventional image forming apparatus.

FIGS. 1 and 2 show an image forming apparatus of the present invention, which comprises a photoconductor unit 1, a developing unit 2, and a rail 18 on which the units 1 and 2 are slidably mounted adjacent to each other, in such a manner that they can be successively slid in the direction in which they are to be pulled out of the body 20 of the apparatus (i.e., toward the right in FIG. 1), for the replacement. The apparatus further comprises a stopper 3 attached to the body 20 and located at the left side of the photoconductor unit 1. Between the photoconductor unit 1 and the stopper 3 is disposed an urging member 4 comprising a spring which urges the photoconductor unit 1 toward the developing unit 2. This naturally causes the photoconductor unit 1 to urge the developing unit 2 toward the right in FIG. 1. On the other hand, provided on the right end of the developing unit 2 is a positioning member 5 which is slidably engaged with the rail 18. The positioning member 5 is locked at a predetermined position of the rail 18 to serve as a stopper against the urging force of the urging member 4. That is, as shown in FIG. 1, the developing unit 2, which is urged toward the right by the photoconductor unit 1, is locked in a predetermined position by the positioning member 5. In this way, the combination of the urging member 4 and the positioning member 5 accurately positions both the photoconductor unit 1 and the developing unit 2, with respect to the other components within the body 20 such as an optical unit 6, a transfer charger 7, and the like.

The body 20 of the image forming apparatus comprises an upper housing 21 and a lower housing 22. The upper housing 21 is pivotably connected to the lower housing 22 at a fulcrum 8 located on the left side of the body 20 so that the upper housing 21 can be swung upward about the fulcrum 8 away from the lower housing 22, as shown in FIG. 2. In this state, the replacement of the photoconductor unit 1 and the developing unit 2 is carried out, as will be described below.

When the photoconductor unit 1 and the developing unit 2 are to be replaced with new ones, a door 19 provided on the right side of the body 20 is opened and then the upper housing 21 is lifted upward as described above, forming an opening between the upper and lower housings 21 and 22 at the right side of the body 20. The positioning member 5 which positions the developing unit 2 in place is then removed, and the developing unit 2 is pulled out along the rail 18 in the direction of arrow A in FIG. 2, which allows the photoconductor unit 1 to be also pushed in the direction of arrow A due to the urging force of the urging member 4. Therefore, the photoconductor unit 1 can be pulled out from a position near the opening formed between the upper and lower housings 21 and 22, where space is not restricted. This facilitates the removal of the photoconductor unit 1 and prevents it from touching and damaging the optical unit 6, the transfer charger 7, and the other adjacent components.

To install the photoconductor unit 1 and the developing unit 2, the photoconductor unit 1 is first mounted, and then, the developing unit 2 is pushed in and locked in position using the positioning member 5. In this situation, the positioning of the two units 1 and 2 is done by the urging member 4 and the positioning member 5. Therefore, a separate positioning member need not be attached to the photoconductor unit 1, thereby simplifying the process of manufacturing the image forming apparatus.

As described above, in the image forming apparatus of the present invention, when the developing unit is pulled out of the body of the apparatus, the urging member pushes the photoconductor unit in the direction in which the unit is to be pulled out. This allows the removal of the photoconductor unit to be carried out in a large space located at a position far outward of the mounting position thereof, thereby facilitating the work for the removal and also preventing the photoconductor unit from touching and damaging the other components adjacent thereto inside the body of the apparatus. Also, when installed in the body of the apparatus, the photoconductor unit is urged toward the developing unit by the urging member and the developing unit is locked in a predetermined position by the positioning member, so that the two units can be kept in position with respect to the other components within the body of the apparatus.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains

What is claimed is:

1. An image forming apparatus, comprising:

a developing unit disposed in a body;

a photoconductor unit disposed in the body;

a rail on which the developing unit and the photoconductor unit are slidably mounted adjacent to each outer, the developing unit and photoconductor unit being mounted in such a manner so as to allow the developing unit and the photoconductor unit to be successively pulled out of the body;

an urging member for urging the photoconductor unit and the developing unit toward the direction in which the photoconductor unit and the developing unit are pulled out of the body; and a positioning member slidably engaged with the rail and lockable at a position on the rail so as to maintain the developing unit in a fixed position, the developing unit being urged at one end by the photoconductor unit toward the positioning member.

2. An apparatus according to claim 1, wherein said body comprises an upper housing and a lower housing, said upper housing being pivotably connected to said lower housing at a fulcrum located on one side of said body, thereby allowing said upper housing to be swung upward about said fulcrum away from said lower housing.

3. An apparatus according to claim 2, wherein said developing unit and said photoconductor unit are successively pulled out of said body in that order in the direction away from said fulcrum.

* * * * *

UNITED STATES PATENT AND TRADEMARK OFFICE

CERTIFICATE OF CORRECTION

PATENT NO. : 5,189,471

DATED : February 23. 1993

INVENTOR(S) : Kouichi Irihara, et al.

It is certified that error appears in the above-indentified patent and that said Letters Patent is hereby corrected as shown below:

The title page, should be deleted to appear as per attached title page.

Signed and Sealed this

Tenth Day of May, 1994

*Attest:*

*Attesting Officer*

BRUCE LEHMAN

*Commissioner of Patents and Trademarks*

US005189471A

United States Patent [19]

Irihara et al.

[11] Patent Number: 5,189,471

[45] Date of Patent: Feb. 23, 1993

[54] IMAGE FORMING APPARATUS WITH SLIDABLY MOUNTED DEVELOPING UNIT AND PHOTOCONDUCTIVE UNIT

[75] Inventors: Kouichi Irihara; Yukinori Andou; Yuhi Yui, all of Nara, Japan

[73] Assignee: Sharp Kabushiki Kaisha, Osaka, Japan

[21] Appl. No.: 534,148

[22] Filed: Jun. 6, 1990

[30] Foreign Application Priority Data

Jun. 7, 1989 [JP] Japan ..... 1-67072[U]

[51] Int. Cl.[5] ..... G03G 21/00; G03G 15/00

[52] U.S. Cl. ..... 355/210

[58] Field of Search ..... 355/200, 210, 211, 212, 355/213

[56] References Cited

U.S. PATENT DOCUMENTS

| | | | |
|---|---|---|---|
| 3,998,537 | 12/1976 | Smith et al. | 355/260 |
| 4,096,826 | 6/1978 | Stange | 355/212 X |
| 4,279,496 | 7/1981 | Silverberg | 355/212 |
| 4,325,626 | 4/1982 | Murata et al. | 355/211 |
| 4,327,992 | 5/1982 | Babicz | 355/210 |
| 4,634,264 | 1/1987 | Takahashi | 355/200 |
| 4,873,548 | 10/1989 | Kobayashi et al. | 355/200 |
| 4,951,093 | 8/1990 | Ishii et al. | 355/211 X |

*Primary Examiner*—Fred L. Braun

*Attorney, Agent, or Firm*—Morrison & Foerster

[57] ABSTRACT

An image forming apparatus shown has a developing unit and a photoconductor unit both of which are disposed in a body. The developing unit and photoconductor unit are slidably mounted adjacent to each other within the body. The mounting and positioning of the units are such as to allow the developing unit and the photoconductor unit to be successively pulled out of the body. The apparatus further includes an urging member which allows the photoconductor unit to be urged toward the developing unit. The body includes upper and lower housings and is designed so that the upper housing can be swung upward about a fulcrum on one side of the body and thereby form an opening between the upper and lower housings on the other side of the body. The apparatus is designed and the components are configured such that when the developing unit is pulled out of the body the photoconductor unit moves toward the opening and the photoconductor unit can be replaced in a large open space near the opening.

3 Claims, 3 Drawing Sheets

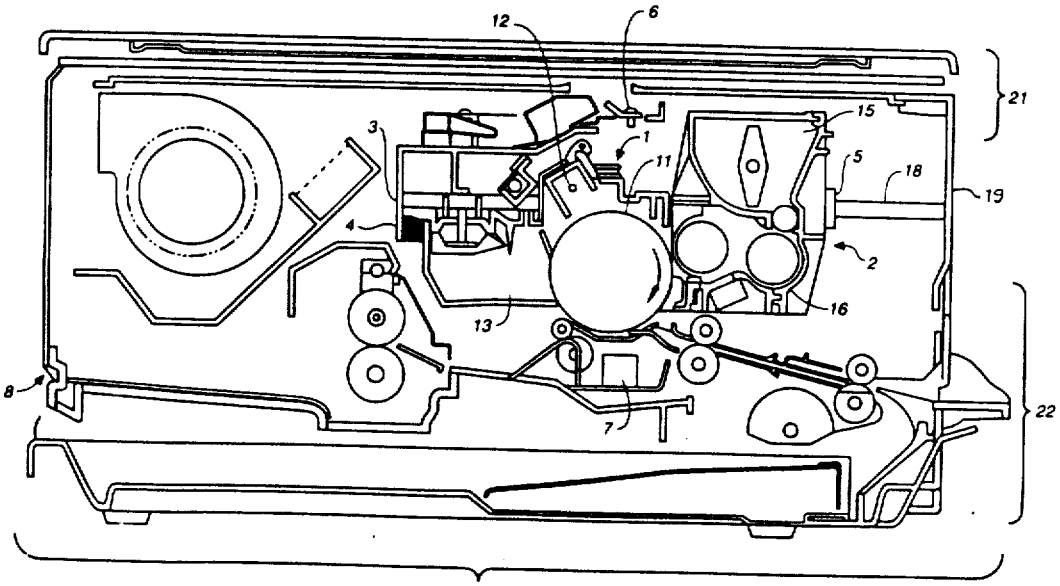

UNITED STATES PATENT AND TRADEMARK OFFICE

CERTIFICATE OF CORRECTION

PATENT NO. : 5,189,471

DATED : February 23, 1993

INVENTOR(S) : Kouichi Irihara; Yukinori Andou; Yuhi Yui

It is certified that error appears in the above-identified patent and that said Letters Patent is hereby corrected as shown below:

In the Drawings:

Please add reference No. 19 to Figure 1 of the patent.

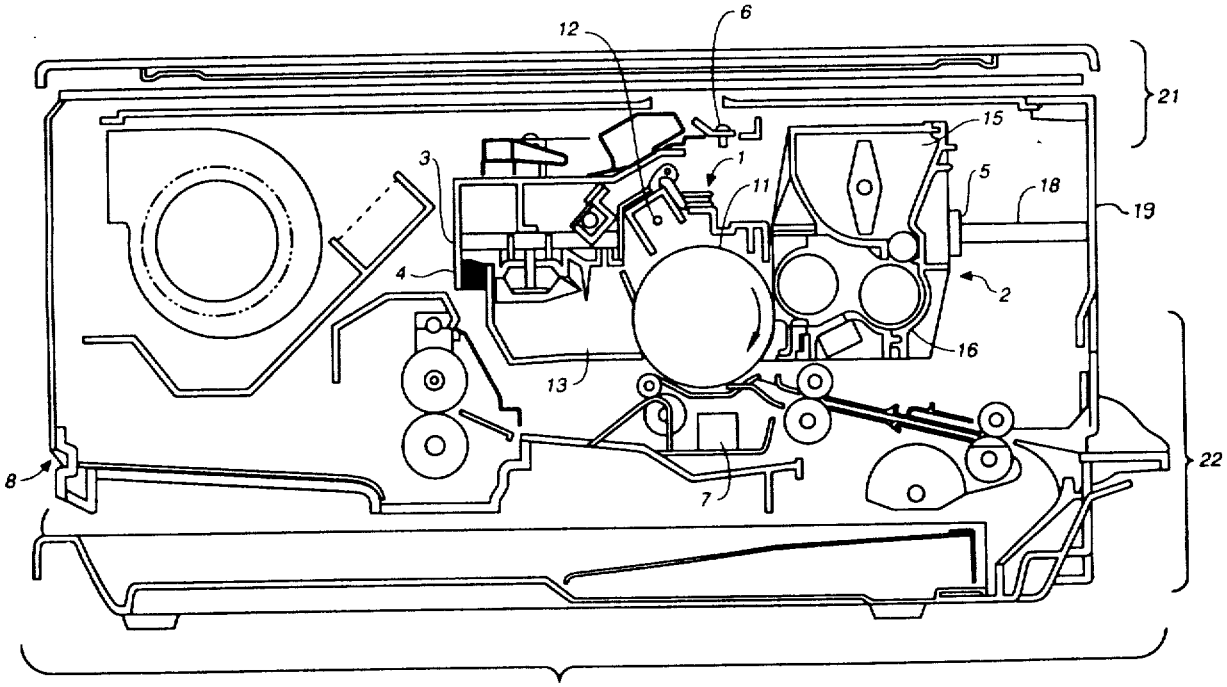

*FIG._1*